US005718094A

United States Patent [19]

Meurer

[11] Patent Number: 5,718,094

[45] Date of Patent: Feb. 17, 1998

[54] SUPPLY AIR REGISTER CONSTRUCTION

[75] Inventor: Henry J. Meurer, Plano, Tex.

[73] Assignee: Eljer Manufacturing, Inc., Dallas, Tex.

[21] Appl. No.: 694,872

[22] Filed: Aug. 9, 1996

[51] Int. Cl.[6] ..... E04C 2/38; F24F 13/06

[52] U.S. Cl. ..... 52/656.8; 52/507; 52/656.1; 52/663; 52/799.12; 49/62; 49/463; 454/330

[58] Field of Search ..... 52/106, 177, 507, 52/656.1, 656.8, 663, 799.11, 799.12; 454/315, 330; 49/61, 62, 463, 465

[56] References Cited

U.S. PATENT DOCUMENTS

| | | | |
|---|---|---|---|
| 915,133 | 3/1909 | Waterbury . | |
| 941,413 | 11/1909 | Hart . | |
| 978,129 | 12/1910 | Bailey . | |
| 1,256,489 | 2/1918 | Truax . | |
| 2,001,681 | 5/1935 | Huff | 52/799.12 X |
| 2,309,717 | 2/1943 | Siebenlist . | |
| 2,473,053 | 6/1949 | De Roo . | |
| 2,835,001 | 5/1958 | Matthews . | |
| 2,955,526 | 10/1960 | Walker et al. . | |
| 3,021,778 | 2/1962 | Slatkovski . | |
| 3,087,412 | 4/1963 | Holmes . | |
| 3,179,034 | 4/1965 | Fain . | |
| 3,336,715 | 8/1967 | Savary . | |
| 3,548,555 | 12/1970 | Trostle et al. . | |

FOREIGN PATENT DOCUMENTS

| | | | |
|---|---|---|---|
| 482091 | 1/1970 | Switzerland | 52/656.1 |
| 1385816 | 3/1975 | United Kingdom | 454/315 |

*Primary Examiner*—Wynn E. Wood
*Assistant Examiner*—Timothy B. Kang
*Attorney, Agent, or Firm*—Catherine E. Bracken; J. Richard Konneker; Marlin R. Smith

[57] ABSTRACT

To reduce undesirable scrap wastage in fabrication thereof, the rectangular metal frame section of a supply air register is formed from four separate side and end stampings having generally U-shaped cross sections along their lengths, and overlapping corner sections joined at both inner and outer peripheral portions of the frame structure to provide it with enhanced strength and rigidity. Side portions of the side and end stampings form in the frame structure an integral rectangular base section in which the flow rate adjustment damper blade and directional adjustment vane portions of the register are directly mounted to avoid the necessity of a separate support frame structure for these portions of the overall supply air register assembly.

10 Claims, 1 Drawing Sheet

SUPPLY AIR REGISTER CONSTRUCTION

BACKGROUND OF THE INVENTION

The present invention generally relates to supply air register apparatus through which heated and/or cooled air is delivered to a conditioned space within a building and, in a preferred embodiment thereof, more particularly relates to a supply air register having an improved frame construction incorporated therein.

To deliver conditioned air (i.e., heated and/or cooled air) to a conditioned space within a building, appropriate supply ductwork is run from a furnace or other type of air conditioning unit to one or more supply air registers mounted on walls (or the floor or ceiling as the case may be) in the space. During operation of the furnace, conditioned air is forced through the ductwork and discharged through the supply air register(s) into the conditioned space.

Conventional supply air registers typically include a rectangular sheet metal frame, supportable over a wall, ceiling or floor opening, and an air delivery quantity control damper structure and associated air discharge directional control vanes operatively secured within the frame. This general type of conventional supply air register carries with it two well known constructional disadvantages.

First, the frame portion of a typical conventional supply air register is fabricated as a one piece metal stamping. This long utilized construction technique leads to a considerable degree of fabrication scrap wastage, thereby undesirably increasing the overall fabrication cost of the damper. Second, the control damper/directional vane portion of the register typically must be formed as a separately framed subassembly that is attached to the one piece main register frame, thereby further increasing the per-register material requirement, and thus the overall fabrication cost of the register.

From the foregoing it can be seen that a need exists for an improved supply air register construction that eliminates or at least substantially reduces the above mentioned problems typically associated with supply air registers of the conventional construction just described. It is accordingly an object of the present invention to provide such an improved supply air register construction.

SUMMARY OF THE INVENTION

In carrying out principles of the present invention, in accordance with a preferred embodiment thereof, an air passage structure, representatively a supply air register, is provided with a specially designed frame apparatus. In the preferred embodiment of the supply air register the frame apparatus has inner and outer peripheral portions and includes a spaced pair of parallel first frame side members each having opposite end portions and a generally U-shaped cross section extending along its length and defined by a base wall portion from which outer and inner transverse side edge flange portions depend. The frame apparatus also includes a spaced pair of parallel second frame side members each having opposite end portions and a generally U-shaped cross section extending along its length and defined by a base wall portion from which outer and inner transverse side edge flange portions depend.

Each end portion of the first frame side members are telescopingly engaged with a corresponding second frame side member end portion, with the inner transverse side edge flange portions of the first and second frame side members defining the inner peripheral portion of the frame apparatus, and the outer transverse side edge flange portions of the first and second frame side members defining the outer peripheral portion of the frame apparatus. The inner and outer tranverse side edge flanges combinatively define a rectangular base section of the frame apparatus bordering the opening thereof.

Attachment means are provided for securing each pair of overlapping frame member end portions along both the inner and outer peripheral portions of the frame apparatus. A plurality of parallel flow rate adjustment damper blades extend across the frame apparatus opening and have opposite end portions pivotally connected directly to the base section of the frame apparatus. Additionally, a plurality of parallel directional adjustment vanes extend across the frame apparatus opening, transversely to the flow rate adjustment damper blades, and have opposite end portions pivotally connected directly to the base section of the frame apparatus.

The use of four separate, corner-interlocked register side frame pieces, each preferably a separate sheet metal stamping, substantially reduces the scrap wastage associated with fabricating the supply air diffuser, thereby reducing its overall manufacturing cost. Additionally, the provision of an integral rectangular base section in the overall frame apparatus, to which the flow rate adjustment damper blades and the directional adjustment vanes are directly connected, further simplifies the construction of the overall supply air register assembly. Moreover, the cross-sectional configuration of the individual frame side members, and the intersecurement of overlapping portions thereof on both inner and outer peripheral portions of the frame apparatus advantageously provides the assembled frame apparatus with enhanced strength and structural rigidity.

DETAILED DESCRIPTION

Figure 1:
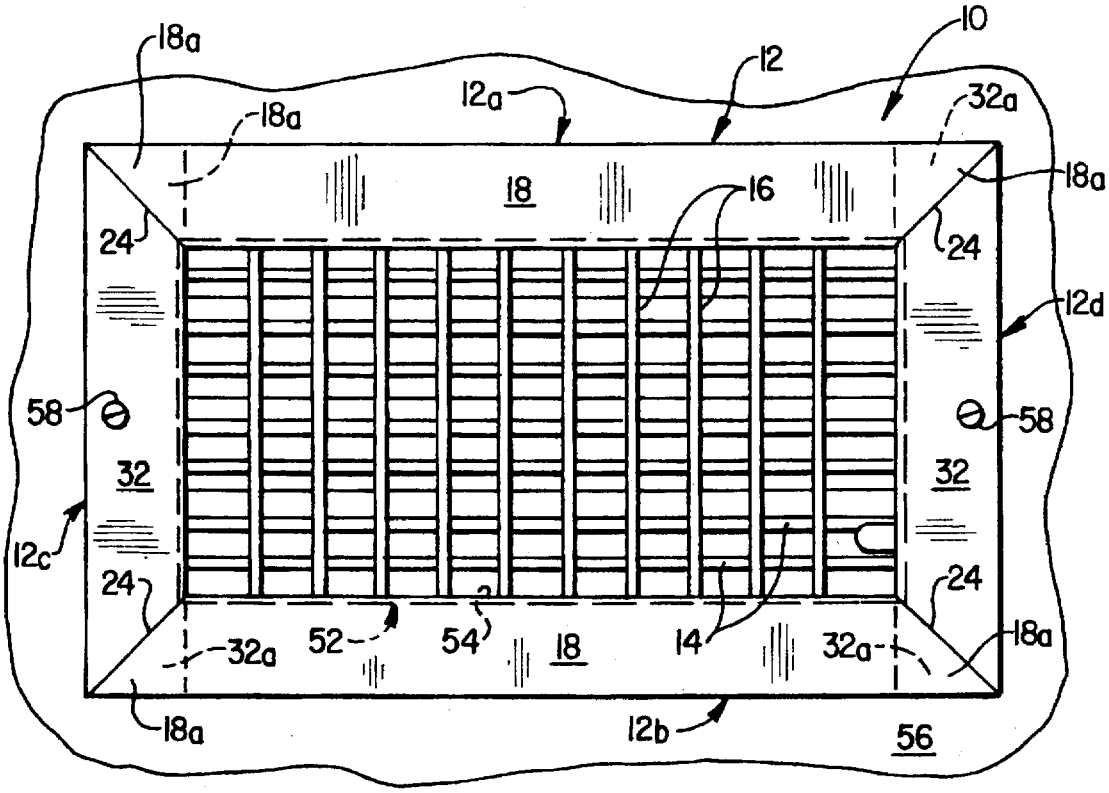
FIG. 1 is an outlet side elevational view of a supply air register incorporating therein an improved frame construction embodying principles of the present invention.
Figure 2:
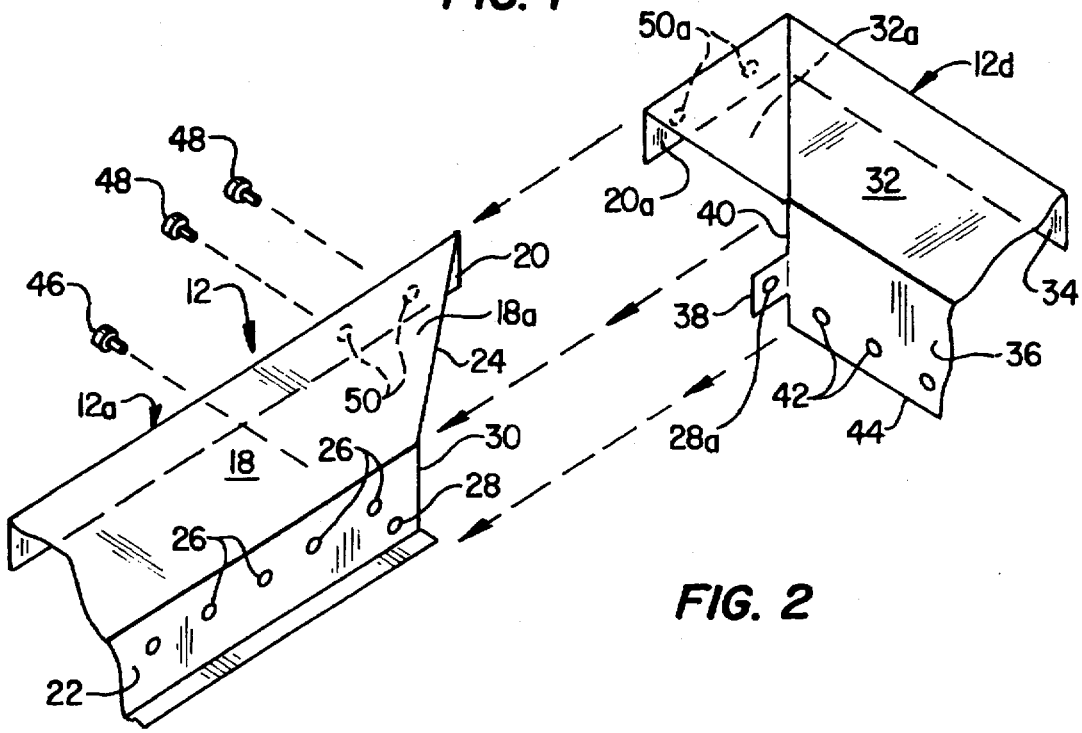
FIG. 2 is an enlarged scale, partially exploded perspective view of a portion of the improved frame construction.

As illustrated in FIGS. 1 and 2, this invention provides an improved supply air register 10 (see FIG. 1) that features a specially designed four piece rectangular frame 12 in which the usual flow rate adjustment damper blades 14 and directional adjustment vanes 16 are pivotally mounted.

Conventional supply air register frames are typically formed as one piece stampings which leads to a considerable degree of fabrication scrap wastage, thereby increasing the overall fabrication cost of the register. Additionally, the damper blade/directional vane portion of the supply air register typically must be formed as a separately framed subassembly that is attached to the one-piece main register frame, thereby further increasing the per-register material requirement.

In contrast to a conventional one piece register frame, the rectangular frame 12 of this invention is formed from four separate aluminum stampings that generate very little scrap—two opposite side portions **12*a* and 12*b*, and two opposite end portions 12*c* and 12*d*. At each corner of the frame 12** the abutting pair of frame sections telescopingly interlock in a unique and simple manner to strengthen the assembled frame.

FIG. 2 shows the manner in which each abutting frame side and end section (for example the illustrated sections **12*a*** and 12*d*) interlock with one another. Frame section 12*a* (like its opposite side section counterpart 12*b*) has a generally U-shaped cross-section along its length defined by a base wall portion 18 from which opposite outer and inner transverse edge flange portions 20 and 22 depend. Each end edge 24 of the base wall portion 18 is mitered at 45 degrees. A horizontally spaced series of connection holes 26 are formed through the flange portion 22 adjacent its juncture with the base wall portion 18, and a connection hole 28 is formed through the flange portion 22 in a bottom right corner thereof, as viewed in FIG. 2, adjacent the right end edge 30 of the flange portion 22.

Frame portion 12*d* also has a generally U-shaped cross section along its length defined by a base wall portion 32 from opposite outer and inner transverse edge flange portions 34 and 36 depend. Each outer end of the frame end section 12*d* (like its opposite frame end section counterpart 12*c*) has a downturned flange portion 20*a*. A rectangular tab 38, having a connection hole 28*a* therein, extends transversely outwardly from the inner end edge 40 of the flange portion 36, and a horizontally spaced series of connection openings 42 are formed in the flange portion 36 adjacent its bottom side edge 44. For purposes later described herein, triangular portions 32*a* at at the opposite ends of each base wall portion 32 are downwardly embossed relative to the balance of the base wall portion 32.

To assemble the frame 12, an end portion of each frame end section is slid into the end portion of its adjacent frame side section and then anchored thereto. For example, with reference to FIG. 2, the illustrated end portion of the frame end section 12*d* is slid into the facing end portion of the frame side section 12*a* until the flange 20*a* underlies the flange 20, and the tab 38 underlies the flange portion 22 with the tab connection opening 28*a* aligned with the connection opening 28. As illustrated in FIG. 1, triangular end portions 18*a* of the frame base walls 18 overlie and are complementarily received in the embossed base wall end portions 32*a* to provide the assembled frame with an essentially planar outer side surface portion. A suitable fastening member, such as the illustrated rivet 46, is extended through the aligned openings 28, 28*a* to anchor the tab 38 to the flange portion 22, and other fastening members, such as the illustrated rivets 48, are extended through aligned openings 50, 50*a* respectively formed in the contiguous flange portions 20, 20*a*.

Opposite ends of the damper blades 14 are pivotally mounted in the opposite sets of connection holes 42, and opposite ends of the direction control vanes 16 are pivotally mounted in the opposite sets of connection holes 26. The two parallel flange portions 22 and the two parallel flange portions 36 combinatively define an integral rectangular base section 52 of the four piece frame portion 12 (see FIG. 1) that underlies the frame base wall portions 18 and 32 and is complementarily received in a corresponding rectangular opening 54 formed in a wall 56 (or floor or ceiling as the case may be) in the conditioned space served by the supply air register 10.

As illustrated in FIG. 1, the base wall portions 18 and 32 of the frame 12 outwardly overlie the wall 56, with the register 10 being secured thereto by suitable screws extended through the frame base wall portions 32 into the wall 56. Supply ductwork (not shown) behind the wall 56 is suitably secured to the frame base section 52 and, on demand, conditioned air is flowed outwardly through the register 10 into the conditioned space.

As previously mentioned, compared to conventionally fabricated one piece supply air register frames, the use of the unique four piece frame structure 12 of the present invention substantially reduces scrap wastage occurring during fabrication of the register, thereby advantageously reducing its overall manufacturing cost. Additionally, the ability provided by the configuration of the frame 12 to connect the damper blades 14 and directional adjustment vanes 16 directly to the integral base section 52 of the frame eliminates the conventional need for a separately fabricated support frame structure for such blades and vanes. Moreover, the unique corner overlapping of the frame sections, with their intersecurement at both peripherally inner and outer sections of the frame (the outer periphery being along the flanges 20, and the inner periphery being along the flanges 22) provides the frame structure with a desirably high degree of strength and rigidity. As will be readily appreciated by those of skill in this particular art, the frame apparatus 12, while representatively illustrated as being incorporated in a supply air register, could alternatively be utilized in other types of air passage structures, such as grilles and diffusers, if desired.

The foregoing detailed description is to be clearly understood as being given by way of illustration and example only, the spirit and scope of the present invention being limited solely by the appended claims.

What is claimed is:

1. Frame apparatus for an air passage structure such as a supply air register, said frame apparatus having inner and outer peripheral portions and including:

a spaced pair of parallel first frame side members each having opposite end portions and a generally U-shaped cross section extending along its length and defined by a base wall portion from which outer and inner transverse side edge flange portions depend;

a spaced pair of parallel second frame side members each having opposite end portions and a generally U-shaped cross section extending along its length and defined by a base wall portion from which outer and inner transverse side edge flange portions depend, each end portion of said first frame side members being telescopingly engaged with a corresponding second frame side member end portion, with said inner transverse side edge flange portions of said first and second frame side members defining said inner peripheral portion of said frame apparatus, and said outer transverse side edge flange portions of said first and second frame side members defining said outer peripheral portion of said frame apparatus; and attachment means for securing each pair of overlapping end portions along both the inner and outer peripheral portions of said frame apparatus, each base wall portion of said second frame side members having downturned opposite end flanges that underlie corresponding end portions of said outer transverse side edge flange portions of said first frame side members, each inner transverse side edge flange portion of said second frame side members having transverse opposite end tabs that underlie corresponding end portions of said inner transverse side edge flange portions of said first frame side members, and said attachment means including:

first means for intersecuring said downturned opposite end flanges to the corresponding end portions of said outer transverse side edge flange portions which they underlie, and second means for intersecuring said transverse opposite end tabs to the corresponding end portions of said inner transverse side edge flange portions of said first frame side members which they underlie.

2. The frame apparatus of claim 1 wherein each of said first and second frame side members is an individual sheet metal stamping.

3. The frame apparatus of claim 1 wherein the opposite end edges on each first frame side member base wall portion are mitered.

4. The frame apparatus of claim 3 wherein the opposite end portions of each second frame side member are telescoped into adjacent opposite end portions of said first frame side members.

5. The frame apparatus of claim 1 wherein:

said first means include a first fastening member extending through each overlapped end flange and corresponding first frame side member outer side edge flange end portion, and said second means include a second fastening member extending through each overlapped end tab and corresponding first frame side member inner transverse side edge flange end portion.

6. A supply air register comprising:

a frame structure having inner and outer peripheral portions and including:

a spaced pair of parallel first frame side members each having opposite end portions and a generally U-shaped cross section extending along its length and defined by a base wall portion from which outer and inner transverse side edge flange portions depend;

a spaced pair of parallel second frame side members each having opposite end portions and a generally U-shaped cross section extending along its length and defined by a base wall portion from which outer and inner transverse side edge flange portions depend, each end portion of said first frame side members being telescopingly engaged with a corresponding second frame side member end portion, with said inner transverse side edge flange portions of said first and second frame side members defining said inner peripheral portion of said frame structure, and said outer transverse side edge flange portions of said first and second frame side members defining said outer peripheral portion of said frame structure, said inner and outer transverse side edge flanges combinatively defining a rectangular base section of said frame structure bordering the opening thereof;

attachment means for securing each pair of overlapping end portions along both the inner and outer peripheral portions of said frame structure;

a plurality of parallel flow rate adjustment damper blades extending across said opening and having opposite end portions pivotally connected directly to said base section of said frame structure; and a plurality of parallel directional adjustment vanes extending across said opening, transversely to said flow rate adjustment damper blades, and having opposite end portions pivotally connected directly to said base section of said frame structure, each base wall portion of said second frame side members having downturned opposite end flanges that underlie corresponding end portions of said outer transverse side edge flange portions of said first frame side members, each inner transverse side edge flange portions of said second frame side members having transverse opposite end tabs that underlie corresponding end portions of said inner transverse side edge flange portions of said first frame side members, and said attachment means including:

first means for intersecuring said downturned opposite end flanges to the corresponding end portions of said outer transverse side edge flange portions which they underlie, and second means for intersecuring said transverse opposite end tabs to the corresponding end portions of said inner transverse side edge flange portions of said first frame side members which they underlie.

7. The supply air register of claim 6 wherein each of said first and second frame side members is an individual sheet metal stamping.

8. The supply air register of claim 6 wherein the opposite end edges on each first frame side member base wall portion are mitered.

9. The supply air register of claim 8 wherein the opposite end portions of each second frame side member are telescoped into adjacent opposite end portions of said first frame side members.

10. The supply air register of claim 6 wherein:

said first means include a first fastening member extending through each overlapped end flange and corresponding first frame side member outer side edge flange end portion, and said second means include a second fastening member extending through each overlapped end tab and corresponding first frame side member inner transverse side edge flange end portion.

* * * * *